United States Patent [19]

Yui et al.

[11] 4,209,077

[45] Jun. 24, 1980

[54] ESCAPE DEVICE FOR USE IN MULTISTORIED BUILDINGS

[76] Inventors: Makoto Yui, 509, 18, 2, Uzugamoridai, Higashinada-ku, Kobe city, Hyogo, Japan; Katsuyuki Sadakane, 403, 33, 8 Chaenba-cho, Akashi city, Hyogo, Japan; Hidemasa Okazaki, 4765-55, Chaenba, Najio, Shiose-cho, Nishinomiya-city, Hyogo, Japan

[21] Appl. No.: 2,082

[22] Filed: Jan. 9, 1979

[51] Int. Cl.[2] ..... A62B 1/00

[52] U.S. Cl. ..... 182/42; 182/36; 182/70; 182/196

[58] Field of Search ..... 182/42, 43, 44, 73, 182/70, 74, 75, 196, 197, 198, 36; 214/14

[56] References Cited

U.S. PATENT DOCUMENTS

| | | | |
|---|---|---|---|
| 1,076,646 | 10/1913 | Scheiden | 182/42 |
| 1,191,504 | 7/1916 | Gray | 182/42 |
| 1,316,604 | 9/1919 | Turner | 182/43 |
| 1,882,145 | 10/1932 | Hirschman | 182/42 |
| 3,894,613 | 7/1975 | Elizondo | 182/43 |

*Primary Examiner*—Reinaldo P. Machado

*Attorney, Agent, or Firm*—Oblon, Fisher, Spivak, McClelland & Maier

[57] ABSTRACT

An escape device for use in tall buildings wherein an endless ladder-type chain driven around a plurality of chain sprockets is mounted on a movable platform and lowered over the side of a building to enable escape to ground level from a burning building. The endless ladder chain is compactly stored when not in use in a housing which includes a pair of inclined rod-like support members by which the endless chain under the force of gravity is slidingly dispensed from the chain housing to the sprocket assembly.

3 Claims, 10 Drawing Figures

ESCAPE DEVICE FOR USE IN MULTISTORIED BUILDINGS

BACKGROUND OF THE INVENTION

1. Field of the Invention

This invention relates to an escape device provided on a roof of a multistoried or high-rise building, and more particularly to an escape device for use in saving lives in the event of an emergency, such as fire.

2. Description of the Prior Art

Recently, a considerable number of fires have occurred in multistoried or high-rise buildings. During the resulting emergency, and despite existing escape provisions in buildings, such as escape stairs, escape chutes, escape ladders and the like for saving lives of escapees, the lives of many people are jeopardized and in the worst case, the loss of lives results. Under the aforenoted circumstances, nevertheless, there is a tendency to increase the height of buildings, so that the conventional type escape devices can no longer ensure the safety of lives of people. Accordingly, many kinds of escape devices have been proposed to this end for multistoried buildings. However, these devices pose problems in the construction and handling of the escape device, and in the safe descent of escapees from a burning building.

SUMMARY OF THE INVENTION

The present invention is directed to avoiding the aforenoted shortcomings or problems experienced with the conventional type escape devices.

It is accordingly an object of the present invention to provide an escape device for use in a multistoried or high-rise building, which device may save the lives of people with ease and in safety, by ensuring the safe descent of escapees.

According to one aspect of the present invention, there is provided the escape device of the type described which comprises: first and second driving sprockets; third and fourth idle sprockets; a ladder type endless chain trained around the first and second driving sprockets, as well as the third and fourth idle sprockets; a ladder-type-endless-chain housing positioned between the first driving sprocket and the fourth idle sprocket but below the first and the fourth sprockets; and a chain-lift prime mover for driving the first and second driving sprockets in both the normal and reverse rotational directions; whereby, in the event of an emergency, the ladder type endless chain admitted in the housing may be suspended between the second driving sprocket and the third idle sprocket, due to the first and second driving sprockets being driven by the chain-lift prime mover, and then the ladder type endless chain may be continuously paid out to descend a looped chain-lift portion.

According to a second aspect of the present invention, there is provided the escape device of the type described, wherein the device further includes at least two rod-type chain supporting members which are rigidly positioned above the endless chain housing but below the first and fourth sprockets, and inclined so as to allow the endless chain to slidingly move therealong by gravity thereof, and the ladder type endless chain is provided with projecting portions or ladder steps which are engageable with the rod type chain supporting members and positioned at a suitable spacing along the chain, so that the latter type endless chain may be paid out from or drawn into the housing along the chain supporting member.

According to a third aspect of the present invention, there is provided the escape device of the type described, wherein a turning prime mover for turning the sprocket housing and the endless chain housing, a wheeled platform mounting the sprocket housing, the endless chain housing and the turning prime mover thereon, and another prime mover for transporting the wheeled platform are positioned below the sprocket housing which is provided with the chain-lift prime mover and the first, second, third and fourth sprockets.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figures 1A, 1B:
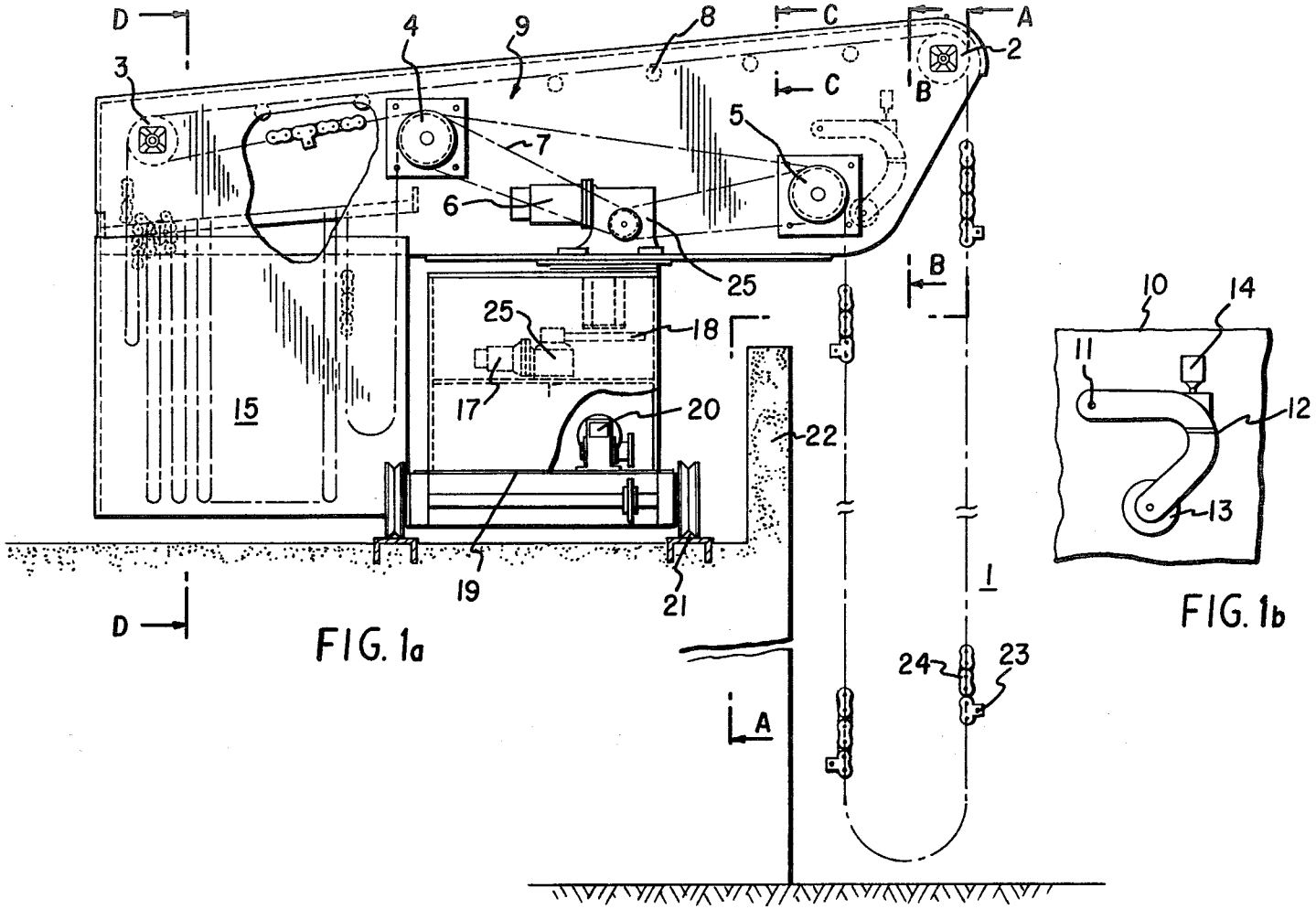
FIGS. 1*a* and 1*b* is an outline of the arrangement of the escape device according to one embodiment of the invention.
Figure 2:
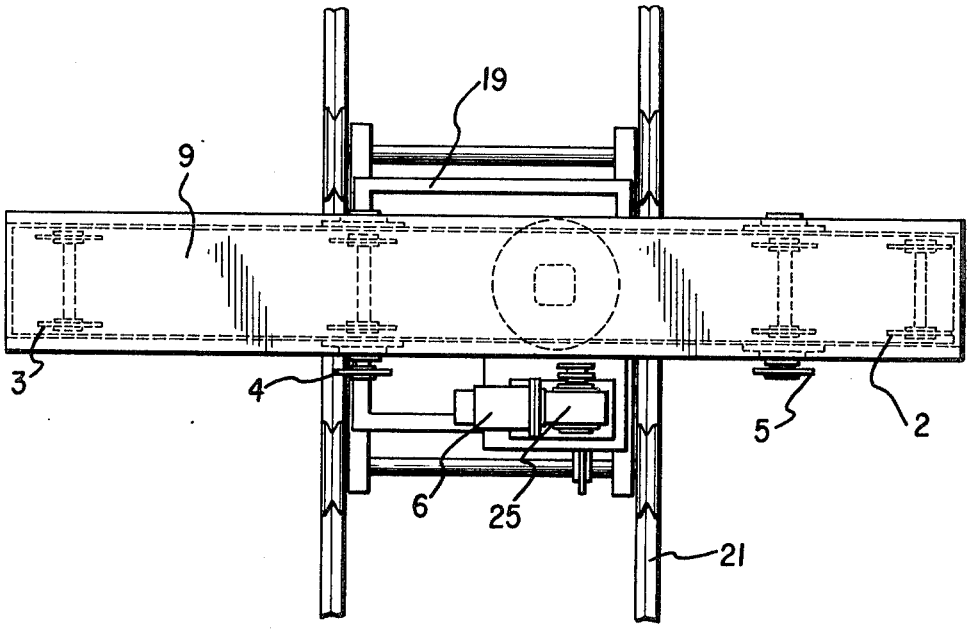
FIG. 2 is a plan view of the embodiment of the invention shown in FIG. 1.
Figure 3:
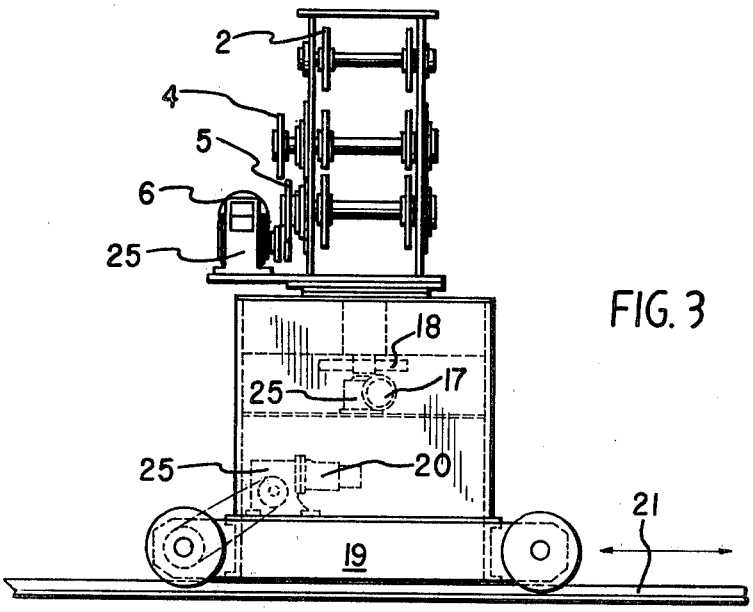
FIG. 3 is a cross-sectional view taken along the line A—A of FIG. 1.
Figure 4:
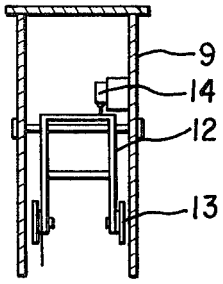
FIGS. 4, 5, 6 are cross-sectional views taken along the line B—B, C—C and D—D of FIG. 1.
Figure 5:
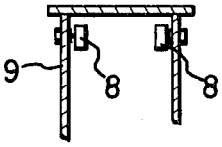
Figure 6:
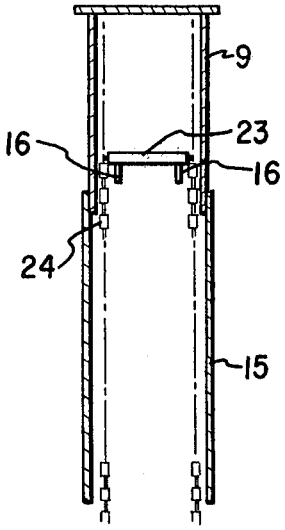
Figure 7A:
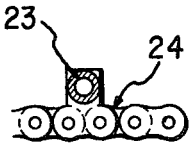
FIG. 7*a* is a view showing an outline of a ladder step and a chain link built in the ladder type endless chain according to the embodiment of the invention.
Figure 7B:
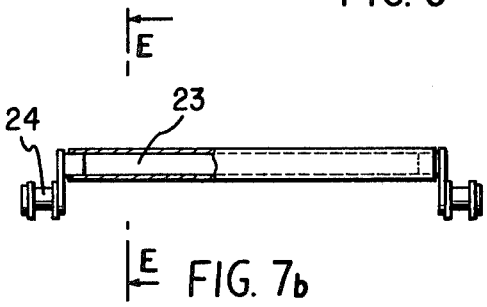
FIG. 7*b* is a cross-sectional view taken along the line E—E of FIG. 7*a;* and, FIG. 8 is a cross-sectional view taken along the line F—F of FIG. 1.
Figure 8:
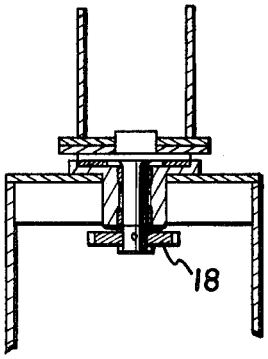

Referring now to the drawings, wherein like reference numerals designate identical or corresponding parts throughout the several views, and more particularly to FIG. 1 thereof, the numeral 1 designates a ladder type endless chain, the numerals 2 and 3 designate third and fourth idle sprockets, respectively, and at 4 and 5 first and second driving sprockets are positioned between the third and the fourth idle sprockets, respectively. Shown at 6 is an endless-chain-lift prime mover which is positioned between the first and second driving sprockets and which drives the first and the second driving sprockets in both normal and reverse directions.

The ladder type endless chain 1 is trained around the first, second, third, and fourth sprockets 4, 5, 2 and 3 respectively so as to drive the same at a given rotational speed. Preferably, cam clutches should be provided for the third and fourth idle sprockets so as to prevent the reverse travelling of the ladder type endless chain. Shown at 8 are cam followers which cope with a slack of the ladder type endless chain due to its gravity, and the cam followers 8 are positioned at a given spacing above the first and second driving sprockets 4 and 5 between the third and fourth idle sprockets 2 and 3. Shown at 9 is a sprocket housing which admits the first, second, third and fourth sprockets therein.

Shown at 10 is a stopper means which is positioned between the second driving sprocket 5 and the third idle sprocket 2, and the stopper means 10 serves to stop the ladder type endless chain, at the completion of the return of the ladder type endless chain into the sprocket housing 9. The stopper means 10 includes: a swingable arm 12 which is freely swingable about a fulcrum 11 positioned above the second driving sprocket 5; an auxiliary idle sprocket 13 mounted on one end portion of the swingable arm 12 so as to prevent the ladder type endless chain from coming off the second driving sprocket 5; and a limit switch 14 adapted to automatically stop the chain-lift prime mover, when the swingable arm 12 contacts the switch 14, upon the completion of the return of the chain into the sprocket housing 9 due to the reverse rotation of the first and second driving sprockets 4, 5. Shown at 15 is a ladder type endless chain housing positioned between the first driving sprocket 4 and the fourth idle sprocket 3 but below the first and fourth sprockets 4 and 3. Shown at 16 are at least two rod type chain supporting members which are positioned above the endless chain housing 15 but below the first and fourth sprockets 4 and 3, and inclined so as to allow the endless chain to slidingly move therealong by gravity thereof. The ladder type endless chain is formed with a projecting portion, (in this embodiment, the projecting portions are ladder steps 23), which engages the rod type chain supporting member 16, so that the endless chain may properly be placed in the endless chain housing in suspended relation from the rod type chain supporting members 16 in order.

Shown at 17 is a turning prime mover which is positioned below the sprocket housing 9 and drives the sprocket housing 9 and endless chain housing 15 so as to turn through an angle of 90° to the right and left, respectively, as viewed from the front of a building. Shown at 19 is a wheeled platform or board which mounts thereon the sprocket housing, endless chain housing and turning prime mover, while the platform 19 is capable of running along rails. Shown at 20 is a platform-travelling prime mover for driving the wheeled platform to travel along the wall of a building. Shown at 21 are rails for guiding the wheeled platform 19 in parallel with the wall of a building on the roof thereof. Meanwhile, shown at 23 and 24 are ladder steps and chain links of the ladder type endless chain 1, respectively. Shown at 25 are reduction gear mechanisms, such as a worm reduction gear mechanisms, mounted on prime movers 6, 17, 20, respectively.

The operation of the escape device according to the invention provided on a roof of a multistoried or high-rised building is now described. In an emergency where fire for instance occurs on a certain story of a multistoried building, the platform-travelling prime mover 20 is first driven so as to move the wheeled platform 19 mounting the escape device according to the invention thereon, along the rails 21, to a position which allows safe escape of people from the story where an emergency has taken place, or escape of people from the stores above a burning story. Then the turning prime mover 17 is driven so as to turn the sprocket housing 9 and endless chain housing 15 through an angle of 90° to the right or to the left through the medium of the turning gear 18, thereby bringing the second driving sprocket 5 and third idle sprocket 2 outside of the fence 22 of a building. Then, the chain-lift prime mover 6 is driven. As a result, the first driving sprocket 4 and second driving sprocket 5 are driven through the medium of a power transmission 7, so that the ladder type endless chain 1 which has been admitted in suspended relation from the rod type supporting members 16 inside the endless chain housing 15 may be suspended between the second drive sprocket 5 and the third idle sprocket 2 along first driving sprocket 4 and second driving sprocket 5 therealong. Subsequently, the ladder type endless chain 1 trained around the first and second driving sprockets 4, 5 as well as around the third and fourth idle sprockets 2, 3 is continuously operated at a given speed so as to allow an escapee to descend in safety. After the escape device according to the invention has been operated completely, the escapees are transferred from a window, an emergency door and the like to the ladder type endless chain 1 one after another, with their hands and feet gripping and placed on the ladder steps 23 of the ladder type endless chain 1, respectively.

In this manner, people to be rescued may reach the ground in safety, quickly, only by gripping by their hands and placing their feet on the ladder steps 23 of the ladder type endless chain 1.

It is noted that in the aforenoted operation, the order of driving the driving prime mover 20 and turning prime mover 17 should not be construed in a limitative sense, so that either one of these may be driven first, or both of them may be driven at the same time. As the case may be, the escape device according to the invention may be operated in its set-up position, without driving the platform-travelling prime mover 20. Furthermore, it is preferable that the ladder type endless chain 1 be suspended to a position spaced such a distance from the ground, that ensures safe escape for escapees. In addition, although not shown, an endless chain fixing base equipped with an idle sprocket may be set up on the ground for preventing the lateral swinging of the endless chain due to wind, during the service of the escape device. Still furthermore, it is preferable that a water and wind proof cover be provided in a manner to enclose the chain-lift prime mover 6 and power transmitting means 7, and the like, therewith.

The escape device for use in a multistoried building according to the present invention in such that the escape device on the wheeled platform 19 may travel along the rails 21 in parallel with the wall surface of a building. Alternatively, however, the rails 21 may be of a movable type in a manner to assume the direction at a right angle to the wall of the building, so that the wheeled platform 19 may travel back and fourth perpendicularly to the wall surface of a building. Still furthermore, the escape device may be rigidly fixed in position, with the rails 21, and platform-travelling prime mover 20 being removed. However, in this case, the operational position of the escape device, i.e., the position in which the ladder type endless chain 1 is suspended with the second driving sprocket 5 and third idle sprocket 2 placed in the sprocket housing 9 being brought outside of the fence 22 of a building, should be suitably fixed. However, in the event of raging fire right under the position of the escape device, when the escape device is thusly fixed thereabove, there arises a failure to ensure the safe escape or descending of people from a building. For this reason, the escape device should preferably run in parallel with the wall surface of a building.

Meanwhile, in the event of fire, electric power may possibly be cut off. Accordingly, an emergency power source for driving the prime moves 6, 17, 20, not necessarily limited to an electric power source, but an emergency power generator such as a diesel generator should preferably be provided. In addition, controlling and operating devices for these emergency power generators may be positioned on the roof of a building, but preferably in a control room, or in a suitable position on the first floor of a building.

It is noted that the length of the ladder type endless chain 1 in the escape device according to the invention is governed by the height of a building, in which the escape device is to be placed. In addition, the number of escapees who can be carried on the ladder type endless chain 1 at a time is dependent on the type of material, strength and weight or the maximum allowable load of the endless chain 1. Furthermore, the allowable safe descending speed of the ladder type endless chain 1, the running speed of the sprocket housing 9, and travelling speed of the wheeled platform 19 are governed by the prime movers 6, 17, 20 and reduction gear mechanisms 25 such as worm reduction gear mechanisms to be mounted on the prime movers 6,17, 20. Accordingly, the aforenoted factors should be determined, taking into considerations the capacity of a building, in which the escape device according to the invention is to be placed.

As is apparent from the foregoing description of the escape device for use in a multisotried building according to the present invention, even if an emergency such as fire occurs, the chain-lift prime mover is driven so as to continuously operate the ladder type endless chain trained around the first and second driving sprockets, as well as around the third and fourth idle sprockets at a travelling speed within a range of a safe descending speed, so that escaping people may be transferred to the ladder type endless chain with ease and in safety from any position of a building. In this respect, the escapees should only grip by hands and place their legs on the ladder steps of the endless chain, when transferred from the building to the endless chain. In addition, a driving energy source may be remote-controlled. Yet furthermore, the provision of the endless chain housing enables compact storage of the chain inside the housing, with the aid of the rod type chain supporting member. In addition, the driving and idle sprockets in the escape device may be brought outside of the fence of a building, and the device may be movable in parallel with the wall surface of a building, thereby ensuring desired safety and compactness in size.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An escape device for use in a multistoried or high-rise building, which device is provided on a roof of said building for emergency use, comprising:

first and second driving sprockets;

third and fourth idle sprockets;

a ladder type endless chain trained around said first and second driving sprockets, as well as said third and fourth idle sprockets;

a ladder-type-endless-chain housing positioned between said first driving sprocket and said fourth idle sprocket but below said first and said fourth sprockets; and a chain-lift prime mover for driving said first and second driving sprockets in the both normal and reverse rotational directions;

whereby in the event of an emergency, said ladder type endless chain admitted in said housing may be suspended between said second driving sprocket and said third idle sprocket, due to said first and second driving sprockets being driven by said chain-lift prime mover and then said ladder type endless chain may be continuously paid out to descend a looped chain-lift portion.

2. An escape device for use in a multistoried or high-rise building, as set forth in claim 1, wherein said device further includes at least two rod-type chain supporting members which are rigidly positioned above said endless chain housing but below said first and fourth sprockets, and inclined so as to allow said endless chain to slidingly move therealong by gravity thereof, and said ladder type endless chain is provided with projecting portions or ladder steps which are engageable with said rod type chain supporting members and positioned at a suitable spacing along said endless chain, so that said endless chain may be paid out from or drawn into said housing along said chain supporting member.

3. An escape device for use in a multistoried or high-rise building, as set forth in claim 1, further comprising:

a turning prime mover for turning said sprocket housing and said endless chain housing;

a wheeled platform mounting said sprocket housing, said endless chain housing and said turning prime mover thereon; and, another prime mover for enabling travel of said wheeled platform;

wherein said turning prime mover, said wheeled platform, and said another prime mover are all positioned below said sprocket housing which is provided with said chain-lift prime mover and said first, second, third and fourth sprockets.

* * * * *